US011007560B2

(12) United States Patent
Matsuo et al.

(10) Patent No.: US 11,007,560 B2
(45) Date of Patent: May 18, 2021

(54) WINDING WIRE MANUFACTURING DEVICE AND CONTROL METHOD FOR THE SAME

(71) Applicant: TOYOTA JIDOSHA KABUSHIKI KAISHA, Toyota (JP)

(72) Inventors: Tsuyoshi Matsuo, Nisshin (JP); Yuki Kamiya, Anjo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 263 days.

(21) Appl. No.: 16/118,548

(22) Filed: Aug. 31, 2018

(65) Prior Publication Data

US 2019/0118236 A1 Apr. 25, 2019

(30) Foreign Application Priority Data

Oct. 25, 2017 (JP) ..... JP2017-206138

(51) Int. Cl.

| | |
|---|---|
| ***B21C 47/00*** | (2006.01) |
| ***B21C 51/00*** | (2006.01) |
| ***B21C 47/14*** | (2006.01) |
| ***B21C 47/28*** | (2006.01) |
| ***B21D 7/12*** | (2006.01) |

(Continued)

(52) U.S. Cl.

CPC ..... *B21C 47/003* (2013.01); *B21C 47/14* (2013.01); *B21C 47/28* (2013.01); *B21C 51/00* (2013.01); *B21D 7/02* (2013.01); *B21D 7/12* (2013.01); *H01F 41/094* (2016.01)

(58) Field of Classification Search

CPC ..... B21C 47/003; B21C 47/345; B21C 47/08; B21C 47/10; H01F 41/094; H01F 41/06; H01F 41/061; H01F 41/071; H01F 41/074; B21D 7/02; B21D 7/024; B21D 7/12; B21D 11/02; B21D 11/06; B21F 3/04; B21B 2275/12; Y10T 29/5121;

(Continued)

(56) References Cited

U.S. PATENT DOCUMENTS 5,343,725 A * 9/1994 Sabine ..... B21D 7/024 72/149
8,713,979 B2 * 5/2014 Schmid ..... B21C 47/02 72/10.2

(Continued)

FOREIGN PATENT DOCUMENTS

CN 105537339 A * 5/2016 ..... B21D 51/00
JP 01-295643 A 11/1989

(Continued)

*Primary Examiner* — Edward T Tolan
*Assistant Examiner* — Katie L. Parr
(74) *Attorney, Agent, or Firm* — Sughrue Mion, PLLC

(57) ABSTRACT

A control method for a winding wire manufacturing device that includes a base, a clamp, a bending top and a controller, includes a first process of detecting a bending torque applied to the bending top at the time of edgewise bending, a second process of determining whether or not a maximum value obtained by removing a torque value in starting the bending top from the bending torque is equal to or smaller than a predetermined value set in advance, and a third process of reducing a clamp load applied to a rectangular wire by the clamp when the maximum value of the bending torque is larger than the predetermined value.

7 Claims, 11 Drawing Sheets

(51) Int. Cl.
*B21D 7/02* (2006.01)
*H01F 41/094* (2016.01)

(58) Field of Classification Search
CPC ..... Y10T 29/5187; Y10T 29/5197; Y10T 29/5198; G01L 3/00; G01L 5/0042
USPC ..... 72/10.2, 18.4, 19.2, 217, 377, 378
See application file for complete search history.

(56) References Cited

U.S. PATENT DOCUMENTS

| | | | | |
|---|---|---|---|---|
| 9,540,209 | B2 * | 1/2017 | Barea | H01F 41/094 |
| 2010/0000624 | A1 * | 1/2010 | Matsushita | H01F 41/082<br>140/124 |
| 2011/0048092 | A1 | 3/2011 | Saigo et al. | |

FOREIGN PATENT DOCUMENTS

| | | | | |
|---|---|---|---|---|
| JP | 2011-010528 | A | 1/2011 | |
| JP | 2017-140648 | A | 8/2017 | |
| WO | 2010/122656 | A1 | 10/2010 | |
| WO | WO-2011055408 | A1 * | 5/2011 | B21D 7/12 |

* cited by examiner

WINDING WIRE MANUFACTURING DEVICE AND CONTROL METHOD FOR THE SAME

CROSS-REFERENCE TO RELATED APPLICATIONS

This application claims priority to Japanese Patent Application No. 2017-206138 filed on Oct. 25, 2017, which is incorporated herein by reference in its entirety.

BACKGROUND

1. Technical Field

The disclosure relates to a winding wire manufacturing device and a control method for the same.

2. Description of Related Art

As disclosed in Japanese Patent Application Publication No. 2011-10528 (JP 2011-10528 A), a general winding wire manufacturing device is configured to manufacture, for example, an edgewise coil by repeating a process of sandwiching a rectangular wire that has been sent out between a clamping surface of a base and a clamping surface of a clamp in a thickness direction of the rectangular wire, pressing the rectangular wire against a shaft portion of the clamp while squeezing the rectangular wire into a space between the clamping surface of the base and the clamping surface of the clamp through the use of a bending top, and subjecting the rectangular wire to edgewise bending.

SUMMARY

Oil is applied to the surface of the rectangular wire such that the rectangular wire can be smoothly subjected to edgewise bending. However, the amount of oil on the surface of the rectangular wire may vary due to factors such as the transport condition of the rectangular wire, a rise in temperature of the rectangular wire, the preservation state of the rectangular wire, the packing state of the rectangular wire, and the like.

Therefore, in the general winding wire manufacturing device, for example, the frictional forces between the clamping surface of the base and the rectangular wire and between the clamping surface of the clamp and the rectangular wire change in pressing the rectangular wire against the shaft portion of the clamp while squeezing the rectangular wire into the space between the clamping surface of the base and the clamping surface of the clamp through the use of the bending top.

At this time, if the frictional forces between the clamping surface of the base and the rectangular wire and between the clamping surface of the clamp and the rectangular wire increase, it becomes difficult to squeeze the rectangular wire into the space between the clamping surface of the base and the clamping surface of the clamp, and it becomes difficult to accurately subject the rectangular wire to edgewise bending. That is, in the general winding wire manufacturing device, the accuracy of edgewise bending is influenced in accordance with the amount of oil on the surface of the rectangular wire.

The disclosure has been made in view of this problem. The disclosure realizes a winding wire manufacturing device and a control method for the same that enable edgewise bending of a rectangular wire with high accuracy regardless of the amount of oil on a surface of the rectangular wire.

Thus, according to a first aspect of the disclosure, there is provided a control method for a winding wire manufacturing device. This winding wire manufacturing device includes a base, a clamp, and a bending top. The base has a first clamping surface that is in contact with one surface of a rectangular wire in a thickness direction of the rectangular wire. The clamp includes a shaft portion and a flange portion fixed to the shaft portion and having a second clamping surface that is in contact with the other surface of the rectangular wire in the thickness direction of the rectangular wire, is movable in the thickness direction of the rectangular wire, and is configured to sandwich the rectangular wire between the first clamping surface of the base and the second clamping surface of the flange portion. The bending top is configured to subject the rectangular wire to edgewise bending by pressing the rectangular wire against the shaft portion of the clamp while squeezing the rectangular wire into a space between the first clamping surface of the base and the second clamping surface of the clamp. The control method includes the following processes, namely, a first process of detecting a bending torque applied to the bending top at a time of the edgewise bending, a second process of determining whether or not a maximum value obtained by removing a torque value in starting the bending top from the bending torque is equal to or smaller than a predetermined value set in advance, and a third process of reducing a clamp load applied to the rectangular wire by the clamp when the maximum value of the bending torque is larger than the predetermined value.

According to the control method as described above, even in the case where it is difficult to squeeze the rectangular wire into the space between the first clamping surface of the base and the second clamping surface of the clamp as a result of the amount of oil on the surface of the rectangular wire in subjecting the rectangular wire to edgewise bending this time, the bending top makes it easy to squeeze the rectangular wire into the space between the first clamping surface of the base and the second clamping surface of the clamp, and the rectangular wire can be favorably pressed against the shaft portion of the clamp, in subjecting the rectangular wire to edgewise bending next time. Therefore, the rectangular wire can be accurately subjected to edgewise bending regardless of the amount of oil on the surface of the rectangular wire.

Besides, in the aforementioned control method, in the third process, the clamp load applied to the rectangular wire by the clamp may be immediately reduced during control of the winding wire manufacturing device, when the maximum value of the bending torque becomes larger than the predetermined value. Besides, in the third process, the clamp load applied to the rectangular wire by the clamp may be reduced after performing control of the winding wire manufacturing device a plurality of times, when the maximum value of the bending torque becomes larger than the predetermined value.

Besides, the aforementioned control method may further include the following processes, namely, a fourth process of determining whether or not it has been successively determined a predetermined number of times that the maximum value of the bending torque is equal to or smaller than the predetermined value, after reducing the clamp load applied to the rectangular wire by the clamp, and a fifth process of returning the clamp load applied to the rectangular wire by the clamp to an initial value set in advance, when it has been successively determined the predetermined number of times that the maximum value of the bending torque is equal to or smaller than the predetermined value. Furthermore, the control method may further include the following process, namely, a sixth process of refraining from adjusting the clamp load applied to the rectangular wire by the clamp when it has not been successively determined the predetermined number of times that the maximum value of the bending torque is equal to or smaller than the predetermined value.

The control method as described above makes it possible to more effectively restrain the rectangular wire from swelling in subjecting the rectangular wire to edgewise bending next time than in subjecting the rectangular wire to edgewise bending this time.

Besides, the aforementioned control method may include the following process, namely, a seventh process of calculating an average of maximum values of the bending torque in subjecting the rectangular wire to edgewise bending a plurality of times. Also, it may be determined, in the second process, whether or not the calculated average of the maximum value of the bending torque is equal to or smaller than the predetermined value.

Besides, according to the aforementioned control method, even in the case where the calculated maximum value of the bending torque sporadically exceeds the predetermined value, for example, in subjecting the rectangular wire to edgewise bending after a certain number of times, the control of the clamp load applied to the rectangular wire by the clamp does not immediately reflect the calculated maximum value of the bending torque. Therefore, it is easy to control the clamp load.

Furthermore, according to a second aspect of the disclosure, there is provided a winding wire manufacturing device that includes a base, a clamp, a bending top, and a controller. The base includes a first clamping surface that is in contact with one surface of a rectangular wire in a thickness direction of the rectangular wire. The clamp includes a shaft portion and a flange portion fixed to the shaft portion and including a second clamping surface that is in contact with the other surface of the rectangular wire in the thickness direction of the rectangular wire, the clamp is movable in the thickness direction of the rectangular wire, and the clamp is configured to sandwich the rectangular wire between the first clamping surface of the base and the second clamping surface of the flange portion. The bending top is configured to subject the rectangular wire to edgewise bending by pressing the rectangular wire against the shaft portion of the clamp while squeezing the rectangular wire into a space between the first clamping surface of the base and the second clamping surface of the clamp. The controller is configured to reduce a clamp load applied to the rectangular wire by the clamp, when a maximum value obtained by removing a torque value in starting the bending top from a bending torque applied to the bending top and detected at a time of the edgewise bending is larger than a predetermined value set in advance.

Besides, according to the aforementioned winding wire manufacturing device, even in the case where it is difficult to squeeze the rectangular wire into the space between the first clamping surface of the base and the second clamping surface of the clamp as a result of the amount of oil on the surface of the rectangular wire in subjecting the rectangular wire to edgewise bending this time, the bending top makes it easy to squeeze the rectangular wire into the space between the first clamping surface of the base and the second clamping surface of the clamp, and the rectangular wire can be favorably pressed against the shaft portion of the clamp, for example, in subjecting the rectangular wire to edgewise bending next time. Therefore, the rectangular wire can be accurately subjected to edgewise bending regardless of the amount of oil on the surface of the rectangular wire.

The winding wire manufacturing device and the control method for the same according to the disclosure enable edgewise bending of a rectangular wire with high accuracy regardless of the amount of oil on a surface of the rectangular wire.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

The concrete embodiments to which the disclosure is applied will be described hereinafter in detail with reference to the drawings. It should be noted, however, that the disclosure is not limited to the following embodiments thereof. Besides, the following description and drawings are simplified as appropriate, for the sake of clarity of explanation.

First of all, the configuration of a winding wire manufacturing device according to the first embodiment of the disclosure will be briefly described. It should be noted, however, that since the winding wire manufacturing device according to the embodiment of the disclosure is identical in basic configuration to the general winding wire manufacturing device, detailed description thereof will be omitted.

Figure 1:
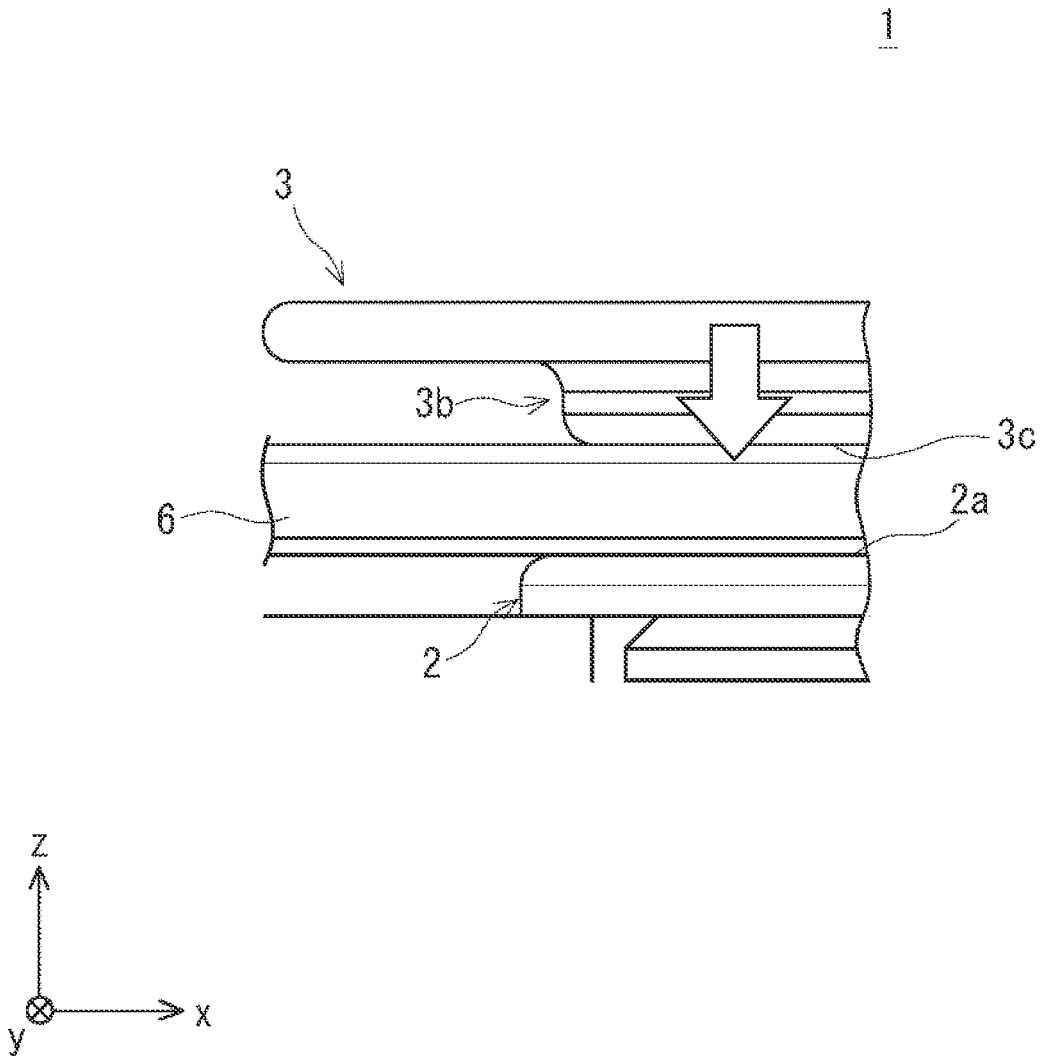
FIG. 1 is a lateral view schematically showing a state where a rectangular wire has not been subjected to edgewise bending through the use of a winding wire manufacturing device according to the first embodiment of the disclosure.
Figure 2:
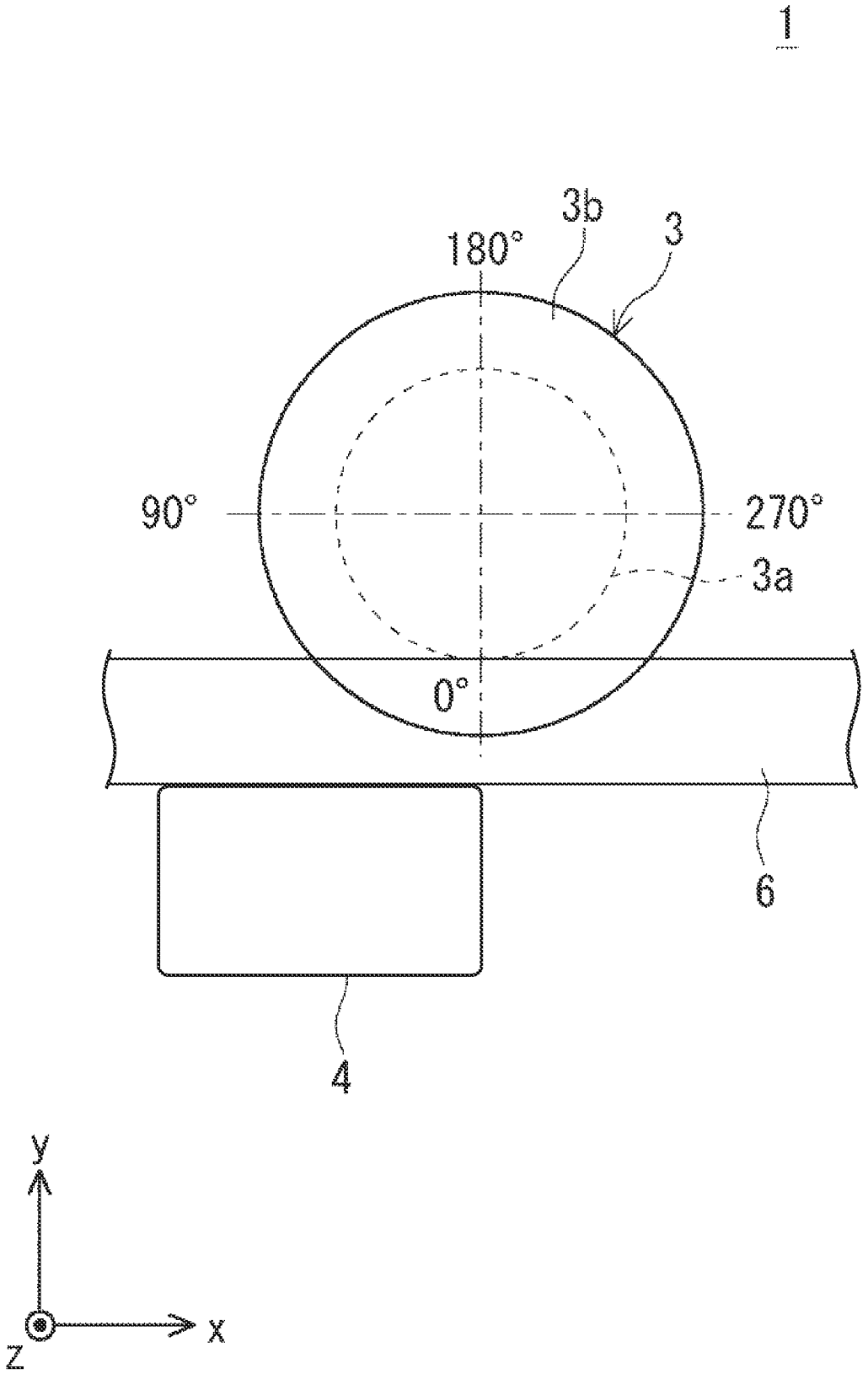
FIG. 2 is a plan view schematically showing the state where the rectangular wire has not been subjected to edgewise bending through the use of the winding wire manufacturing device according to the first embodiment of the disclosure.
Figure 3:
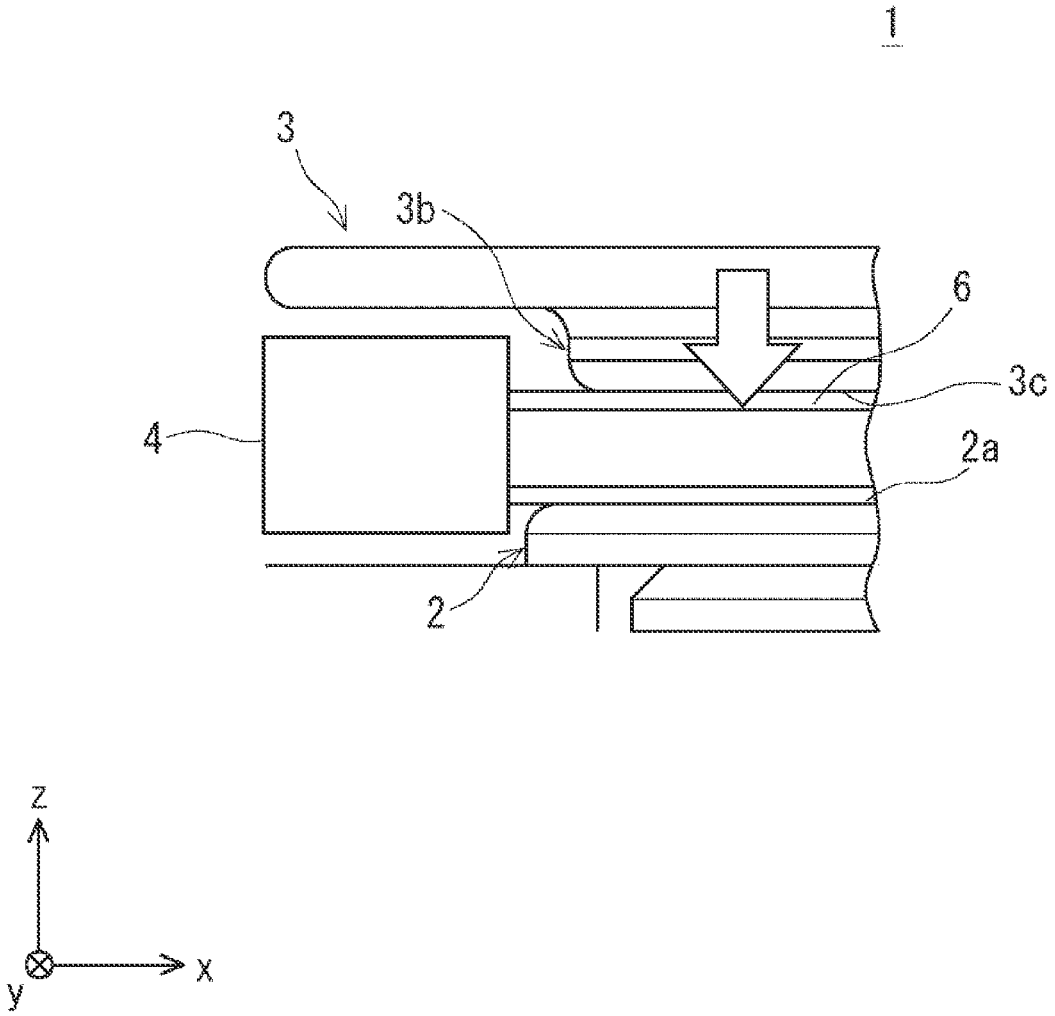
FIG. 3 is a lateral view schematically showing a state where the rectangular wire has been subjected to edgewise bending through the use of the winding wire manufacturing device according to the first embodiment of the disclosure.
Figure 4:
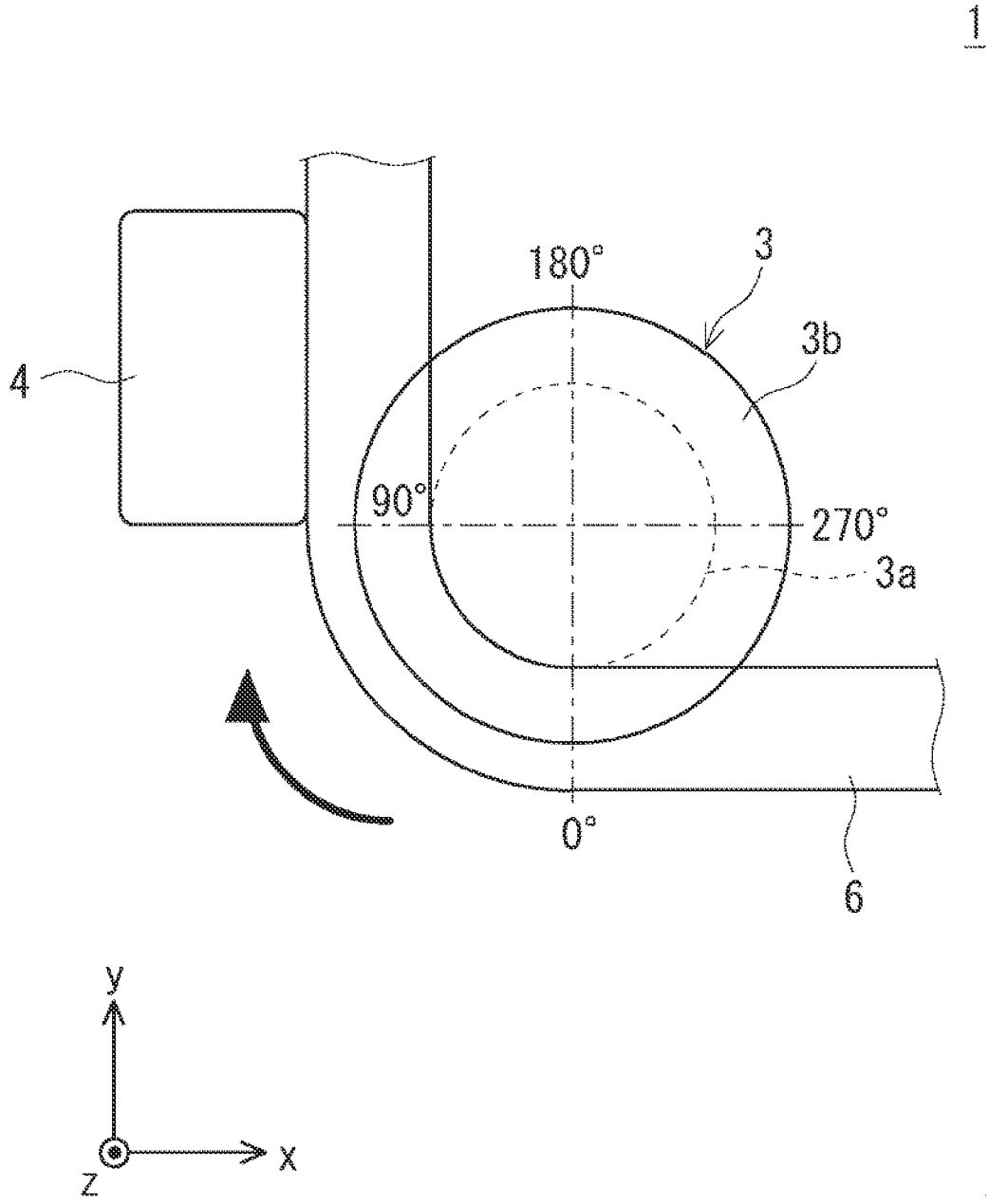
FIG. 4 is a plan view schematically showing the state where the rectangular wire has been subjected to edgewise bending through the use of the winding wire manufacturing device according to the first embodiment of the disclosure.
Figure 5:
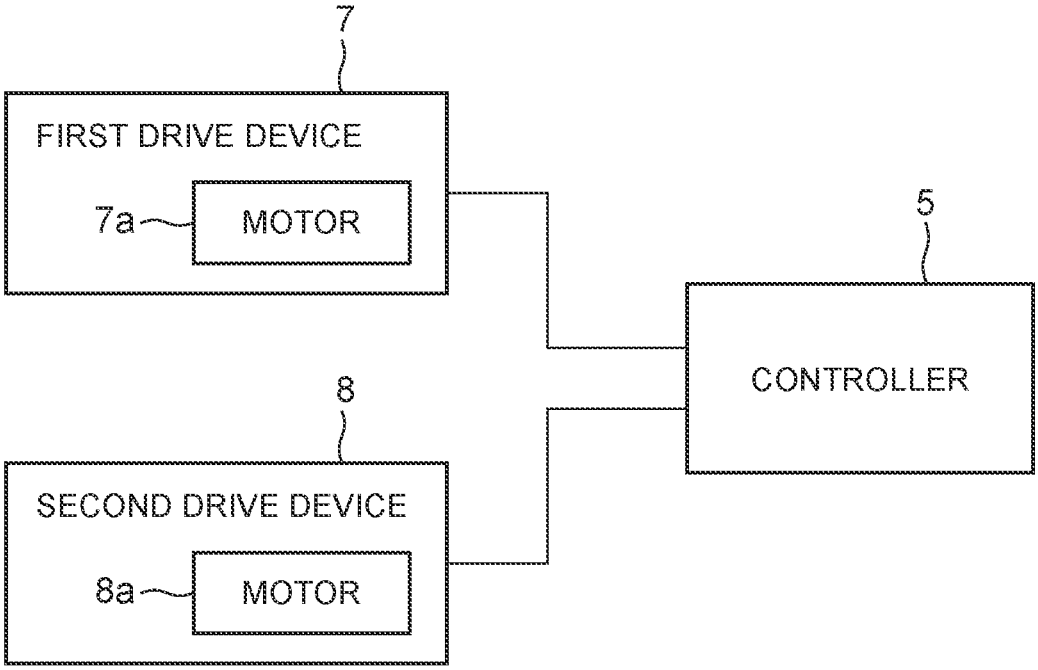
FIG. 5 is a block diagram of a control system of the winding wire manufacturing device according to the first embodiment of the disclosure.

FIG. 1 is a lateral view schematically showing a state where a rectangular wire has not been subjected to edgewise bending through the use of the winding wire manufacturing device according to the first embodiment of the disclosure. FIG. 2 is a plan view schematically showing the state where the rectangular wire has not been subjected to edgewise bending through the use of the winding wire manufacturing device according to the first embodiment of the disclosure. FIG. 3 is a lateral view schematically showing a state where the rectangular wire has been subjected to edgewise bending through the use of the winding wire manufacturing device according to the first embodiment of the disclosure. FIG. 4 is a plan view schematically showing the state where the rectangular wire has been subjected to edgewise bending through the use of the winding wire manufacturing device according to the first embodiment of the disclosure. FIG. 5 is a block diagram of a control system of the winding wire manufacturing device according to the first embodiment of the disclosure.

Incidentally, the following description will be given through the use of a three-dimensional coordinate system (an XYZ coordinate system), for the sake of clarity of explanation. It should be noted herein that a Z-axis direction corresponds to a thickness direction of a rectangular wire 6.

A winding wire manufacturing device 1 according to the first embodiment of the disclosure can be favorably used in, for example, manufacturing an edgewise coil (a winding wire) by subjecting a rectangular wire to edgewise bending. As shown in FIGS. 1 to 5, the winding wire manufacturing device 1 is equipped with a base 2, a clamp 3, a bending top 4, and a controller 5.

The base 2 is fixed at a predetermined height position in the Z-axis direction. Also, a surface of the base 2 on the positive side of the Z-axis is substantially arranged on an XY plane, and functions as a clamping surface (a first clamping surface) 2*a* that cooperates with the clamp 3 to sandwich the rectangular wire 6.

The clamp 3 is equipped with a shaft portion 3*a* and a flange portion 3*b*, and can be moved in the Z-axis direction by a first drive device 7 (see FIG. 5). As shown in FIG. 5, the first drive device 7 is equipped with a first motor 7*a*, and a driving force of the first motor 7*a* is transmitted to the clamp 3 via a decelerator (not shown) or the like.

The shaft portion 3*a* extends in the Z-axis direction and has a substantially circular XY cross-section. It should be noted, however, that the XY cross-section may assume the shape of a circular arc only where the rectangular wire 6 is in contact with the shaft portion 3*a*, and may assume any shape as long as the rectangular wire 6 can be bent at a desired bending angle.

The flange portion 3*b* is fixed to an end portion of the shaft portion 3*a* on the positive side of the Z-axis, and basically assumes the shape of a circular disc as shown in, for example, FIG. 2. Also, a surface of the flange portion 3*b* on the negative side of the Z-axis is substantially arranged on the XY plane, and functions as a clamping surface (a second clamping surface) 3*c* that cooperates with the clamping surface 2*a* of the base 2 to sandwich the rectangular wire 6. It should be noted, however, that the flange portion 3*b* may assume any shape as long as the rectangular wire 6 can be favorably sandwiched between the flange portion 3*b* and the base 2.

As shown in FIGS. 3 and 4, the bending top 4 is caused to rotate (revolve) around an axis of rotation extending in the Z-axis direction within an angular range set in advance (e.g., a range of 0° to 90°) by a second drive device 8 (see FIG. 5).

Thus, the bending top 4 subjects the rectangular wire 6 to edgewise bending by pressing the rectangular wire 6 against a lateral surface of the shaft portion 3*a* of the clamp 3 while squeezing the rectangular wire 6 into a space between the clamping surface 2*a* of the base 2 and the clamping surface 3*c* of the clamp 3.

As shown in FIG. 5, the second drive device 8 is equipped with a second motor 8*a*. A driving force of the second motor 8*a* is transmitted to the bending top 4 via a decelerator (not shown) or the like.

The controller 5 controls the first motor 7*a* of the first drive device 7 and the second motor 8*a* of the second drive device 8 to manufacture the edgewise coil by, for example, subjecting the rectangular wire 6 to edgewise bending the number of times set in advance.

At this time, the controller 5 calculates (detects) a bending torque applied to the bending top 4 based on, for example, a current value of the second motor 8*a* of the second drive device 8, and controls the first motor 7*a* of the first drive device 7 based on the calculated bending torque, although the details thereof will be described later. It should be noted, however, that the bending torque applied to the bending top 4 may be detected by a torque detection unit with which the winding wire manufacturing device 1 is equipped, and that the method of detecting the bending torque is not limited.

Figure 6:
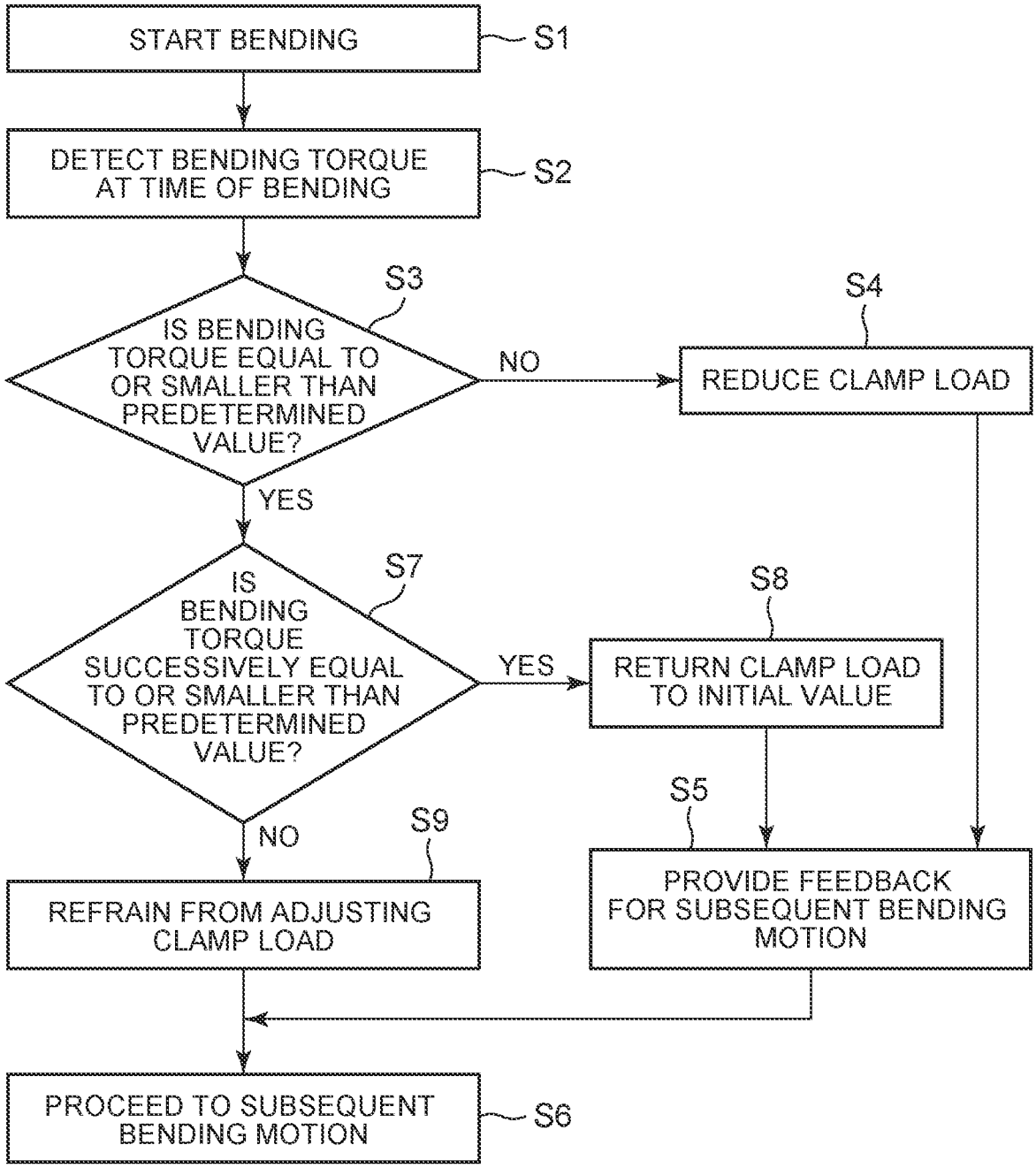
FIG. 6 is a flowchart of a control method for the winding wire manufacturing device according to the first embodiment of the disclosure.

Next, a control method for the winding wire manufacturing device 1 according to the first embodiment of the disclosure will be described. FIG. 6 is a flowchart of the control method for the winding wire manufacturing device according to the first embodiment of the disclosure. It should be noted herein that the bending top 4 is arranged at an initial position shown in FIG. 2 (i.e., a position of 0°) when the winding wire manufacturing device 1 is in an initial state. Besides, the clamp 3 has moved to the positive side of the Z-axis.

The rectangular wire 6 sent out from this initial state is subjected to edgewise bending (S1). More specifically, the rectangular wire 6 is sent out by a feed device (not shown) and is arranged between the clamping surface 2*a* of the base 2 and the clamping surface 3*c* of the clamp 3 and between the shaft portion 3*a* of the clamp 3 and the bending top 4.

Subsequently, the controller 5 controls the first motor 7*a* of the first drive device 7, moves the clamp 3 in the negative direction of the Z-axis, and sandwiches the rectangular wire 6 between the clamping surface 2*a* of the base 2 and the clamping surface 3*c* of the clamp 3.

At this time, the controller 5 calculates a value of a torque to be generated by the first motor 7*a* of the first drive device 7 based on a preset relationship between the clamp load and the torque, for example, such that the clamp load applied to the rectangular wire 6 by the clamp 3 becomes equal to a desired value. Then, the controller 5 calculates a current value of the first motor 7*a* of the first drive device 7 based on a preset relationship between the torque value and the current value such that the first motor 7*a* generates the calculated torque value, and controls the first motor 7*a* with the calculated current value.

Subsequently, the controller 5 controls the second motor 8*a* of the second drive device 8, rotates the bending top 4, and presses the rectangular wire 6 against the lateral surface of the shaft portion 3*a* of the clamp 3 while squeezing the rectangular wire 6 into the space between the clamping surface 2*a* of the base 2 and the clamping surface 3*c* of the clamp 3.

At this time, the controller 5 controls the second motor 8*a* of the second drive device 8 based on a detection value of an encoder (not shown) with which the second drive device 8 is equipped, for example, such that the bending top 4 rotates within an angular range set in advance.

Incidentally, in the first embodiment of the disclosure, as shown in FIG. 4, the bending top 4 is rotated clockwise by 90° from the position of 0° as viewed from the positive side of the Z-axis, but the rotational direction and angular range of the bending top 4 can be appropriately changed in accordance with the arrangement and desired bending angle of the rectangular wire 6 that is sent out.

Figure 7:
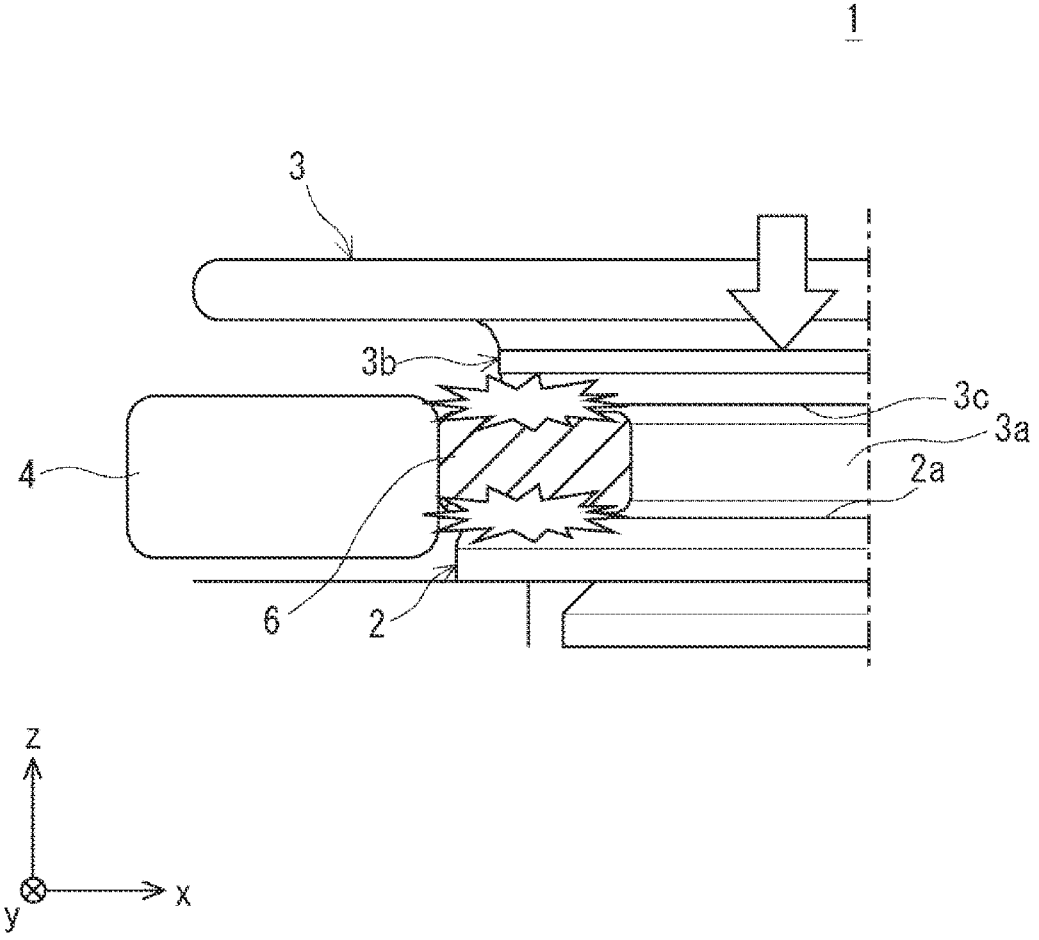
FIG. 7 is a view schematically showing how friction occurs between a clamping surface of a base of the winding wire manufacturing device and the rectangular wire and between a clamping surface of a clamp and the rectangular wire.
Figure 8:
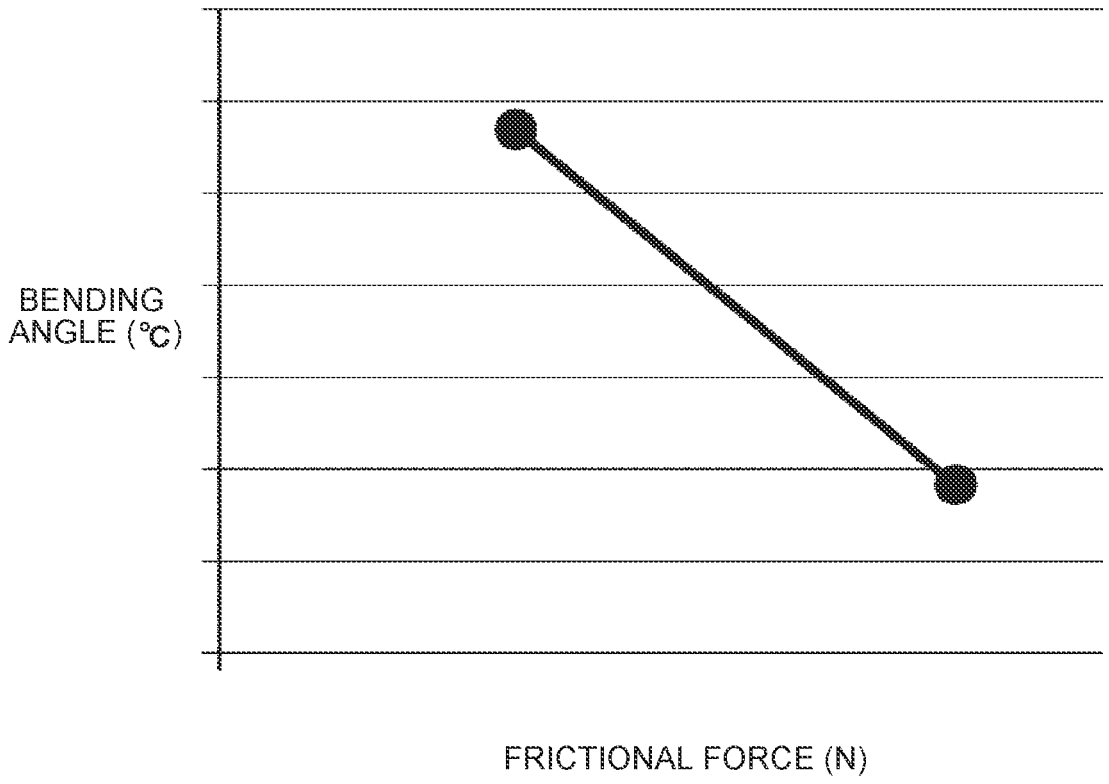
FIG. 8 is a view showing a relationship between the bending angle and frictional force of the rectangular wire in the winding wire manufacturing device.
Figure 9:
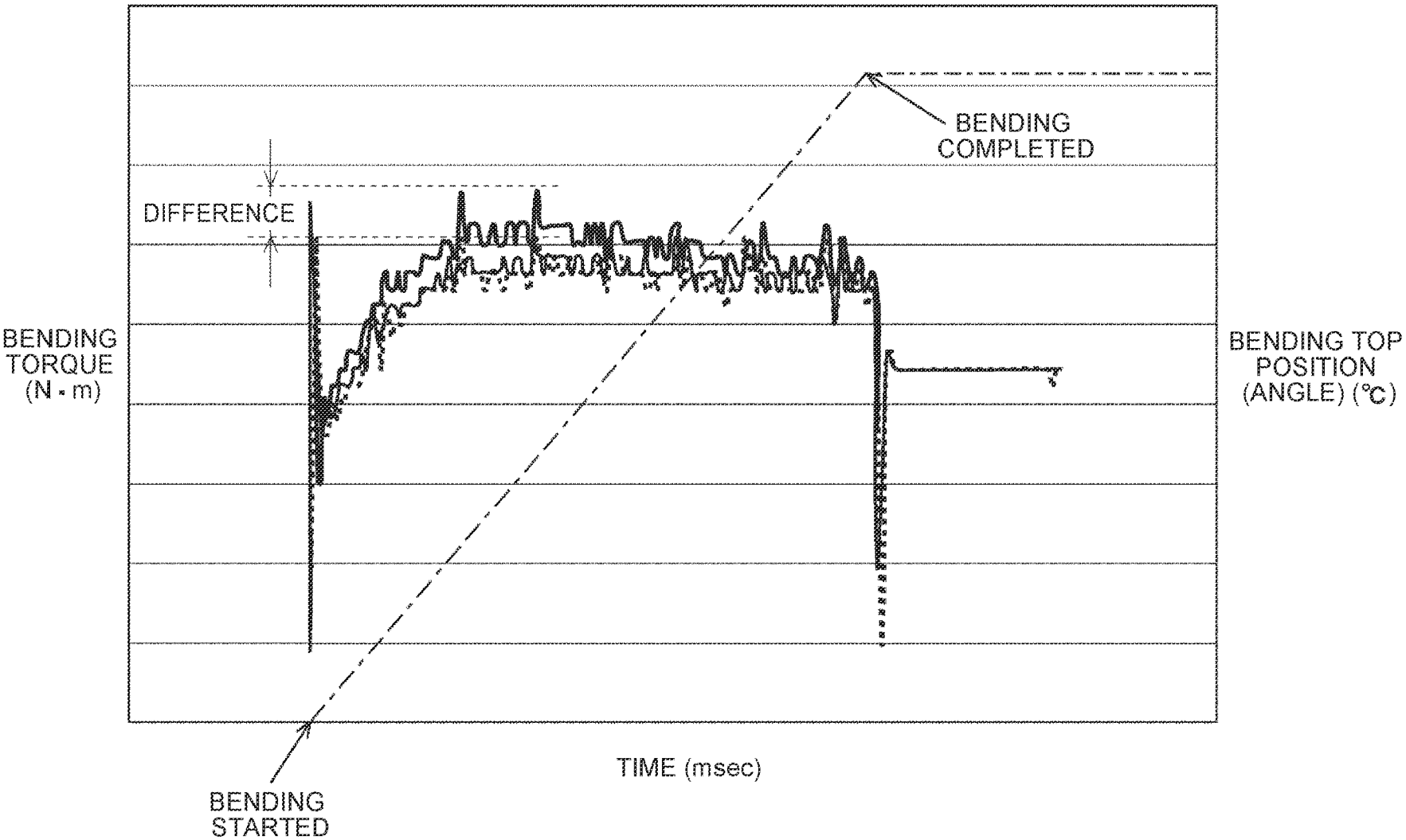
FIG. 9 is a view showing a difference between a bending torque applied to a bending top in subjecting the rectangular wire with oil applied to a surface thereof to edgewise bending through the use of the bending top and a bending torque applied to the bending top in subjecting the rectangular wire with no oil applied to the surface thereof to edgewise bending through the use of the bending top.

It should be noted herein that FIG. 7 is a view schematically showing how friction occurs between the clamping surface of the base and the rectangular wire and between the clamping surface of the clamp and the rectangular wire. FIG. 8 is a view showing a relationship between the bending angle and frictional force of the rectangular wire. FIG. 9 is a view showing a difference between a bending torque applied to the bending top in subjecting the rectangular wire with oil applied to a surface thereof to edgewise bending through the use of the bending top and a bending torque applied to the bending top in subjecting the rectangular wire with no oil applied to the surface thereof to edgewise bending through the use of the bending top.

In subjecting the rectangular wire 6 to edgewise bending, friction occurs between the clamping surface 2*a* of the base 2 and the rectangular wire 6 and between the clamping surface 3*c* of the clamp 3 and the rectangular wire 6 as shown in FIG. 7. However, as described above, the frictional force between the rectangular wire 6 and each of the clamping surface 2*a* of the base 2 and the clamping surface 3*c* of the clamp 3 changes in accordance with the amount of oil on the surface of the rectangular wire 6.

At this time, the frictional force can be obtained according to 〈Equation 1〉 shown below.

$$F=\mu\times N$$

〈Equation 1〉

It should be noted, however, that F denotes a frictional force at the time of edgewise bending (i.e., the sum of the frictional force between the clamping surface 2*a* of the base 2 and the rectangular wire 6 and the frictional force between the clamping surface 3*c* of the clamp 3 and the rectangular wire 6), that μ denotes a friction coefficient of the rectangular wire 6 (i.e., a friction coefficient of the rectangular wire 6 with oil applied to the surface thereof in the case where the oil is applied to the surface thereof), and that N denotes a clamp load applied to the rectangular wire 6 by the clamp 3.

It should be noted herein that an upper-left plot in FIG. 8 indicates a relationship between the frictional force and the bending angle in subjecting the rectangular wire 6 with oil applied to the surface thereof to edgewise bending, and that a lower-right plot in FIG. 8 indicates a relationship between the frictional force and the bending angle in subjecting the rectangular wire 6 with no oil applied to the surface thereof to edgewise bending. As shown in FIG. 8, it is difficult to bend the rectangular wire 6 when the frictional force is large, and it is easy to bend the rectangular wire 6 when the frictional force is small.

Also, a broken line in FIG. 9 indicates a relationship between the time and the bending torque in subjecting the rectangular wire 6 with oil applied to the surface thereof to edgewise bending, a solid line in FIG. 9 indicates a relationship between the time and the bending torque in subjecting the rectangular wire 6 with no oil applied to the surface thereof to edgewise bending, and an alternate long and short dash line in FIG. 9 indicates a relationship between the time and the rotational angle of the bending top 4. As shown in FIG. 9, the rectangular wire 6 with no oil applied to the surface thereof needs a larger bending torque than the rectangular wire 6 with oil applied to the surface thereof, in subjecting the rectangular wire 6 to edgewise bending.

As described hitherto, there is a difference between the bending torque in subjecting the rectangular wire 6 with oil applied to the surface thereof to edgewise bending and the bending torque in subjecting the rectangular wire 6 with no oil applied to the surface thereof to edgewise bending, as shown in FIGS. 8 and 9. Accordingly, a change in the frictional force between the rectangular wire 6 and each of the clamping surface 2*a* of the base 2 and the clamping surface 3*c* of the clamp 3 can be derived in such a manner as to correspond to this difference, based on the relationships shown in FIGS. 8 and 9.

Thus, in the first embodiment of the disclosure, the clamp load applied to the rectangular wire 6 by the clamp 3 is controlled such that the frictional force becomes equal to or smaller than a desired value, based on a relationship between the difference between the maximum value of the bending torque in subjecting the rectangular wire 6 with oil applied to the surface thereof to edgewise bending (however, the torque value immediately after the start of the bending top 4 is removed therefrom) and the maximum value of the bending torque in subjecting the rectangular wire 6 with no oil applied to the surface thereof to edgewise bending (however, the torque value immediately after the start of the bending top 4 is removed therefrom) and the change in the frictional force between the rectangular wire 6 and each of the clamping surface 2*a* of the base 2 and the clamping surface 3*c* of the clamp 3.

More specifically, the controller 5 calculates a bending torque applied to the bending top 4 based on a current value of the second motor 8*a* of the second drive device 8 (S2). Then, the controller 5 determines whether or not the calculated maximum value of the bending torque applied to the bending top 4 (however, the torque value immediately after the start of the bending top 4 is removed therefrom) is equal to or smaller than a predetermined value set in advance (S3).

It should be noted herein that the predetermined value can be obtained according to, for example, 〈Equation 2〉 shown below.

$$S=A+3\sigma$$

〈Equation 2〉

It should be noted, however, that S denotes the predetermined value, that A denotes an average of maximum values of the bending torque in subjecting the rectangular wire 6 with oil applied to the surface thereof to edgewise bending a plurality of times (e.g., 20 times, but the number of times is not limited) (however, the torque value immediately after the start of the bending top 4 is removed therefrom), and that σ denotes a standard deviation of the maximum values of the bending torque in subjecting the rectangular wire 6 to edgewise bending the plurality of times (however, the torque value immediately after the start of the bending top 4 is removed therefrom).

Incidentally, the predetermined value S in the first embodiment of the disclosure is set using the standard deviation σ, but may be set using an average deviation. Besides, the coefficient of the standard deviation σ can be appropriately changed. Furthermore, the average A may be set as the predetermined value S. In short, the predetermined value S can be appropriately set based on the maximum value of the bending torque in subjecting the rectangular wire 6 with oil applied to the surface thereof to edgewise bending.

Subsequently, if the calculated maximum value of the bending torque is larger than the predetermined value (NO in S3), the controller 5 calculates a difference between the maximum value of the bending torque and the predetermined value, and then calculates, from this difference, an amount of decrease in the clamp load applied to the rectangular wire 6 by the clamp 3 in subjecting the rectangular wire 6 to edgewise bending (S4).

More specifically, the controller 5 calculates a value of the frictional force to be reduced, based on a preset relationship between the bending torque and the frictional force and a difference between the calculated bending torque and the predetermined value. The preset relationship between the bending torque and the frictional force can be set based on, for example, a relationship between the above-mentioned difference between the maximum value of the bending torque in subjecting the rectangular wire 6 with oil applied to the surface thereof to edgewise bending (however, the torque value immediately after the start of the bending top 4 is removed therefrom) and the maximum value of the bending torque in subjecting the rectangular wire 6 with no oil applied to the surface thereof to edgewise bending (however, the torque value immediately after the start of the bending top 4 is removed therefrom) and the change in the frictional force between the rectangular wire 6 and each of the clamping surface 2*a* of the base 2 and the clamping surface 3*c* of the clamp 3.

Subsequently, the controller 5 calculates a value of the clamp load to be reduced, based on the preset relationship between the frictional force and the clamp load and the calculated value of the frictional force to be reduced. The preset relationship between the frictional force and the clamp load can be set based on, for example, a relationship between the frictional force between each of a plurality of rectangular wires 6 and each of the clamping surface 2*a* of the base 2 and the clamping surface 3*c* of the clamp 3 and the clamp load applied to each of the rectangular wires 6 by the clamp 3 in subjecting the plurality of the rectangular wires 6 to edgewise bending at an equal bending angle in advance.

Subsequently, the controller 5 calculates a torque value of the first motor 7*a* of the first drive device 7 to be reduced, based on the preset relationship between the clamp load and the torque and the calculated value of the clamp load to be reduced. Then, the controller 5 calculates a current value of the first motor 7*a* of the first drive device 7 to be reduced, based on a preset relationship between the torque and the current and the calculated torque value of the first motor 7*a* of the first drive device 7 to be reduced.

Subsequently, the controller 5 performs feedback to cause the current value of the first motor 7*a* of the first drive device 7 in subsequently subjecting the rectangular wire 6 to edgewise bending to reflect the calculated current value of the first motor 7*a* of the first drive device 7 to be reduced (S5).

Then, the controller 5 shifts to the control of subsequently subjecting the rectangular wire 6 to edgewise bending (S6). At this time, the first motor 7*a* of the first drive device 7 is driven based on the current value subjected to feedback such that the clamp load applied to the rectangular wire 6 by the clamp 3 decreases. Therefore, the clamp load applied to the rectangular wire 6 by the clamp 3 in subjecting the rectangular wire 6 to edgewise bending this time is smaller than the clamp load applied to the rectangular wire 6 by the clamp 3 in subjecting the rectangular wire 6 to edgewise bending last time.

Thus, even though it is difficult to squeeze the rectangular wire 6 into the space between the clamping surface 2*a* of the base 2 and the clamping surface 3*c* of the clamp 3 as a result of the amount of oil on the surface of the rectangular wire 6 in subjecting the rectangular wire 6 to edgewise bending last time, the bending top 4 makes it easy to squeeze the rectangular wire 6 into the space between the clamping surface 2*a* of the base 2 and the clamping surface 3*c* of the clamp 3, and the rectangular wire can be favorably pressed against the shaft portion of the clamp in subjecting the rectangular wire 6 to edgewise bending next time. Therefore, the rectangular wire 6 can be accurately subjected to edgewise bending regardless of the amount of oil on the surface of the rectangular wire 6.

In particular, according to the first embodiment of the disclosure, the clamp load applied to the rectangular wire 6 by the clamp 3 is reduced in accordance with the difference between the predetermined value and the bending torque applied to the bending top 4, which changes in accordance with the amount of oil on the surface of the rectangular wire 6. Therefore, an appropriate clamp load can be calculated in accordance with the amount of oil on the surface of the rectangular wire 6.

On the other hand, if the calculated maximum value of the bending torque is equal to or smaller than the predetermined value (YES in S3), the controller 5 determines whether or not it has been successively determined a predetermined number of times that the maximum value of the bending torque is equal to or smaller than the predetermined value after reducing the clamp load applied to the rectangular wire 6 by the clamp 3 (S7).

Figure 10:
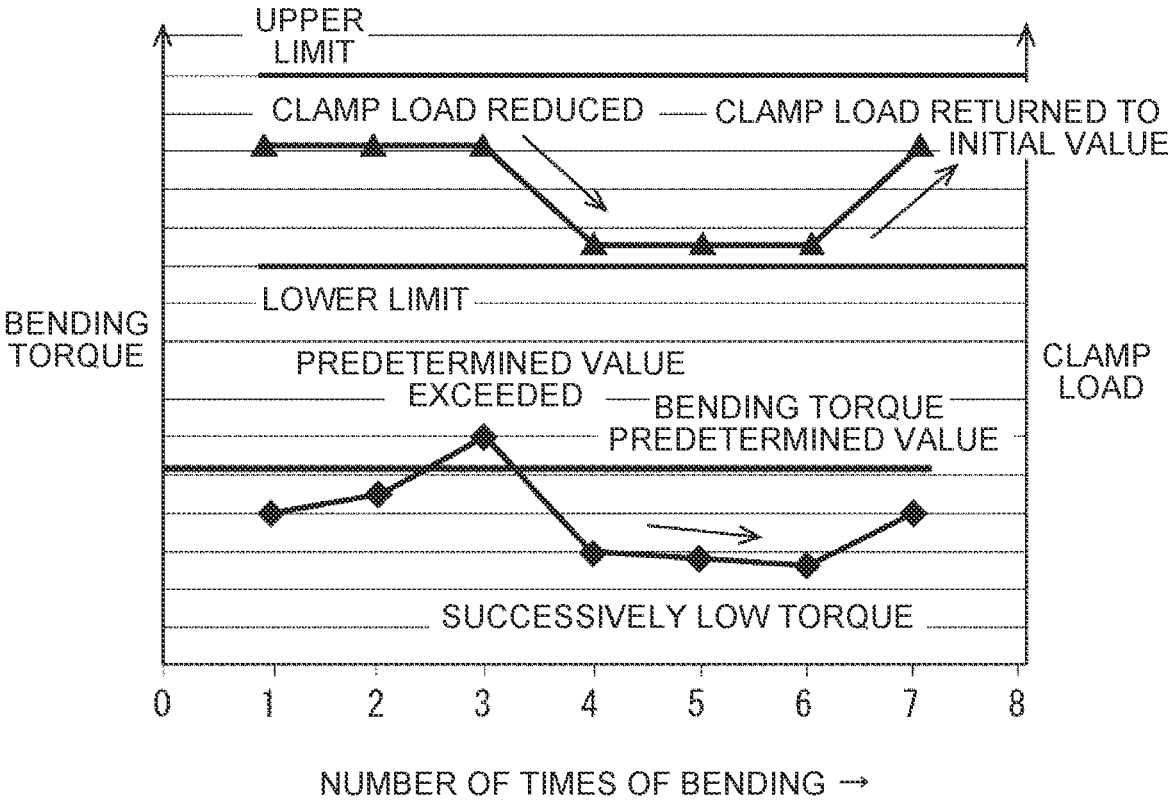
FIG. 10 is a view consisting of an upper stage exemplifying a relationship between the number of times of bending of the rectangular wire and the clamp load, and a lower stage exemplifying a relationship between the number of times of bending of the rectangular wire and the bending torque.

It should be noted herein that the upper stage of FIG. 10 exemplifies a relationship between the number of times of bending of the rectangular wire 6 and the clamp load, and that the lower stage of FIG. 10 exemplifies a relationship between the number of times of bending of the rectangular wire 6 and the bending torque.

For example, as indicated by the upper stage of FIG. 10, in the case where upper and lower limits of the clamp load applied to the rectangular wire 6 by the clamp 3 are set in advance, when the clamp load is reduced a plurality of times, this clamp load continues to be set to the lower limit.

Thus, in the first embodiment of the disclosure, if it has been successively determined the predetermined number of times that the maximum value of the bending torque is equal to or smaller than the predetermined value (YES in S7), the controller 5 calculates a current value for returning the clamp load applied to the rectangular wire 6 by the clamp 3 to an initial value set in advance in subsequently subjecting the rectangular wire 6 to edgewise bending (S8).

For example, if it has been successively determined three times that the maximum value of the bending torque is equal to or smaller than the predetermined value after having become larger than the predetermined value as indicated by the lower stage of FIG. 10, the clamp load applied to the rectangular wire 6 by the clamp 3 is returned to the initial value as indicated by the upper stage of FIG. 10.

The initial value can be set, for example, between the upper limit and the lower limit, but can be appropriately changed. Besides, the number of times by which it is successively determined that the maximum value of the bending torque is equal to or smaller than the predetermined value can also be appropriately changed.

Subsequently, the controller 5 performs feedback to cause the current value of the first motor 7*a* of the first drive device 7 in subsequently subjecting the rectangular wire 6 to edgewise bending to reflect the current value of the first motor 7*a* of the first drive device 7 calculated to return the clamp load applied to the rectangular wire 6 by the clamp 3 to the initial value (S5).

Then, the controller 5 shifts to the control of subsequently subjecting the rectangular wire 6 to edgewise bending (S6). At this time, the first motor 7*a* of the first drive device 7 is driven based on the current value subjected to feedback such that the clamp load applied to the rectangular wire 6 by the clamp 3 returns to the initial value. Therefore, the rectangular wire 6 can be more effectively restrained from swelling when being subjected to edgewise bending this time than when being subjected to edgewise bending last time.

On the other hand, if it has not been successively determined the predetermined number of times that the maximum value of the bending torque is equal to or smaller than the predetermined value (NO in S7), the controller 5 shifts to the control of subsequently subjecting the rectangular wire 6 to edgewise bending (S6) without returning the clamp load applied to the rectangular wire 6 by the clamp 3 to the initial value (S9).

As described hitherto, in the winding wire manufacturing device 1 and the control method for the same according to the first embodiment of the disclosure, when the maximum value of the bending torque applied to the bending top 4 becomes larger than the predetermined value, the clamp load applied to the rectangular wire 6 by the clamp 3 is reduced.

Therefore, for example, even when the frictional force between the rectangular wire 6 and each of the clamping surface 2*a* of the base 2 and the clamping surface 3*c* of the clamp 3 increases due to a small amount of oil on the surface of the rectangular wire 6 in subjecting this rectangular wire 6 to edgewise bending this time, the frictional force between the rectangular wire 6 and each of the clamping surface 2*a* of the base 2 and the clamping surface 3*c* of the clamp 3 can be reduced in subjecting the rectangular wire 6 to edgewise bending next time.

As a result, for example, in subsequently subjecting the rectangular wire 6 to edgewise bending, the bending top 4 makes it easy to squeeze the rectangular wire 6 into the space between the clamping surface 2*a* of the base 2 and the clamping surface 3*c* of the clamp 3, and the rectangular wire 6 can be favorably pressed against the shaft portion 3*a* of the clamp 3.

Thus, the rectangular wire 6 can be accurately subjected to edgewise bending regardless of the amount of oil on the surface of the rectangular wire 6. As a result, the bending angle can be restrained from varying, and an edgewise coil can be stably manufactured. Moreover, the management of the amount of oil on the rectangular wire 6 can be simplified, and the cost of distribution can be reduced.

In particular, according to the first embodiment of the disclosure, the clamp load applied to the rectangular wire 6 by the clamp 3 is reduced in accordance with the difference between the predetermined value and the bending torque applied to the bending top 4, which changes in accordance with the amount of oil on the surface of the rectangular wire 6. Therefore, an appropriate clamp load can be calculated in accordance with the amount of oil on the surface of the rectangular wire 6.

Incidentally, in the aforementioned first embodiment of the disclosure, the clamp load applied to the rectangular wire 6 by the clamp 3 in subsequently subjecting the rectangular wire 6 to edgewise bending is caused to reflect the clamp load to be reduced, which has been calculated based on the difference between the calculated bending torque and the predetermined value, but the timing of reflection is not limited in particular. For example, the clamp load to be reduced may be reflected in subjecting the rectangular wire 6 to edgewise bending for the first time after doing so a plurality of times.

Besides, the clamp load to be reduced may not necessarily be calculated based on the difference between the calculated bending torque and the predetermined value every time the rectangular wire 6 is subjected to edgewise bending. For example, this calculation may be carried out every time the rectangular wire 6 is subjected to edgewise bending a plurality of times.

Furthermore, in the aforementioned first embodiment of the disclosure, if it has been successively determined the predetermined number of times that the maximum value of the bending torque is equal to or smaller than the predetermined value, the clamp load applied to the rectangular wire 6 by the clamp 3 is returned to the initial value in subsequently subjecting the rectangular wire 6 to edgewise bending. However, the clamp load may be returned to the initial value in manufacturing the edgewise coil through the use of the new rectangular wire 6, and the timing for returning the clamp load to the initial value is not limited. Besides, in the case where no lower limit of the clamp load is set, there is no need to return the clamp load to the initial value.

Next, a winding wire manufacturing device and a control method for the same according to the second embodiment of the disclosure will be described. In the first embodiment of the disclosure, the clamp load to be reduced is calculated based on the bending torque in subjecting the rectangular wire 6 to edgewise bending once. However, the clamp load to be reduced may be calculated based on the bending torque in subjecting the rectangular wire 6 to edgewise bending a plurality of times.

Figure 11:
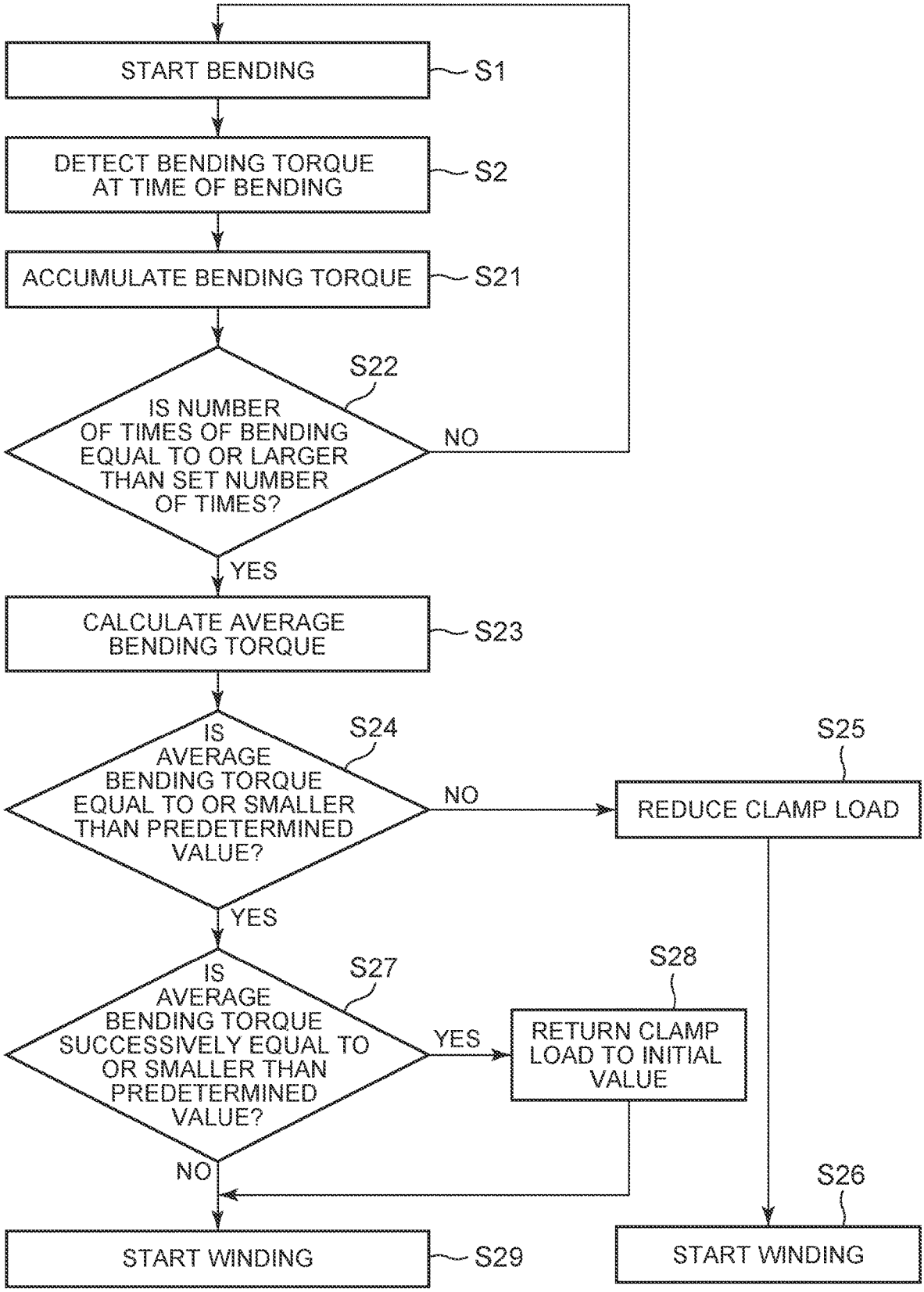
FIG. 11 is a flowchart of a control method for a winding wire manufacturing device according to the second embodiment of the disclosure.

FIG. 11 is a flowchart of the control method for the winding wire manufacturing device according to the second embodiment of the disclosure. Incidentally, in FIG. 11, processes equivalent to those of the control method for the winding wire manufacturing device according to the first embodiment of the disclosure are denoted by the same reference symbols (e.g., S1 and the like) respectively, and redundant description thereof will be omitted.

It should be noted herein that the clamp load is not adjusted during the manufacture of the edgewise coil through the use of the rectangular wire 6 in the control method for the winding wire manufacturing device according to the second embodiment of the disclosure. That is, in the control method for the winding wire manufacturing device according to the second embodiment of the disclosure, the clamp load is adjusted in manufacturing the edgewise coil through the use of the new rectangular wire 6. Therefore, the following processes are carried out while subjecting the rectangular wire 6 to edgewise bending.

More specifically, in the control method for the winding wire manufacturing device according to the second embodiment of the disclosure, the controller 5 accumulates a bending torque applied to the bending top 4 in subjecting the rectangular wire 6 to edgewise bending as shown in FIG. 11 (S21). That is, the controller 5 stores the value of the bending torque applied to the bending top 4 every time the rectangular wire 6 is subjected to edgewise bending. Then, the controller 5 determines whether or not the accumulated bending torque is equal to or larger than a value corresponding to a preset number of times of bending (a set number of times) (S22).

Subsequently, if the accumulated bending torque is smaller than the value corresponding to the preset number of times of bending, the controller 5 returns to the process of S1 (NO in S22). On the other hand, if the accumulated bending torque is equal to or larger than the value corresponding to the preset number of times of bending (YES in S22), the controller 5 calculates an average of maximum values of the bending torque thus accumulated (however, the torque value immediately after the start of the bending top 4 is removed therefrom) (S23).

Subsequently, the controller 5 determines whether or not the average of the maximum values of the bending torque is equal to or smaller than a predetermined value (S24). Then, if the average of the maximum values of the bending torque is larger than the predetermined value (NO in S24), the controller 5 calculates a clamp load to be reduced based on a difference between the average of the maximum values of the bending torque and the predetermined value, and causes, for example, the current value of the first motor 7*a* of the first drive device 7 in manufacturing an edgewise coil after using the plurality of the rectangular wires 6 to reflect the calculated clamp load to be reduced (S25).

After that, in starting the manufacture of the edgewise coil through the use of the new rectangular wire 6 after manufacturing edgewise coils through the use of the plurality of the rectangular wires 6, the controller 5 controls the first motor 7*a* of the first drive device 7 based on the current value calculated such that the clamp load applied to the rectangular wire 6 by the clamp 3 decreases (S26).

On the other hand, if the average of the maximum values of the bending torque is equal to or smaller than the predetermined value (YES in S24), the controller 5 determines whether or not it has been successively determined a predetermined number of times that the average of the maximum values of the bending torque is equal to or smaller than the predetermined value after reducing the clamp load applied to the rectangular wire 6 by the clamp 3 (S27).

Subsequently, if it has been successively determined the predetermined number of times that the average of the maximum values of the bending torque is equal to or smaller than the predetermined value (YES in S27), the controller 5 calculates a current value for returning the clamp load applied to the rectangular wire 6 by the clamp 3 to an initial value set in advance, and causes the current value of the first motor 7*a* of the first drive device 7 in manufacturing an edgewise coil through the use of the subsequent rectangular wire 6 to reflect the calculated current value (S28).

Then, the controller 5 controls the first motor 7*a* of the first drive device 7 based on the current value calculated such that the clamp load applied to the rectangular wire 6 by the clamp 3 returns to the initial value, in starting the manufacture of the edgewise coil through the use of the subsequent rectangular wire 6 (S29).

On the other hand, if it has not been successively determined the predetermined number of times that the average of the maximum values of the bending torques is equal to or smaller than the predetermined value (NO in S27), the controller 5 manufactures the edgewise coil through the use of the subsequent rectangular wire 6 without returning the clamp load applied to the rectangular wire 6 by the clamp 3 to the initial value (S29).

As described hitherto, in the winding wire manufacturing device and the control method for the same according to the second embodiment of the disclosure, the average of the maximum values of the bending torques that is calculated every time the rectangular wire 6 is subjected to edgewise bending a plurality of times is compared with the predetermined value. Therefore, even when the calculated maximum value of the bending torque sporadically exceeds the predetermined value in subjecting the rectangular wire 6 to edgewise bending after a certain number of times, the control of the clamp load applied to the rectangular wire 6 by the clamp 3 does not immediately reflect the calculated maximum value of the bending torque. Therefore, the control of the first motor 7*a* of the first drive device 7 is easy to perform and is independent of the influence of a locally varying amount of oil, so the quality of bending can be stabilized.

Incidentally, in the aforementioned second embodiment of the disclosure, the clamp load to be reduced is reflected in manufacturing the edgewise coil after using the plurality of the rectangular wires 6, but the timing of reflection is not limited. For example, the clamp load to be reduced may be reflected in manufacturing the edgewise coil through the use of the subsequent rectangular wire 6 or in subjecting the rectangular wire 6 to edgewise bending next time or after a plurality of times.

Besides, in the aforementioned second embodiment of the disclosure, the clamp load is returned to the initial value in manufacturing the edgewise coil through the use of the subsequent rectangular wire 6, but the timing for returning the clamp load to the initial value is not limited. For example, the clamp load may be returned to the initial value in subjecting the rectangular wire 6 to edgewise bending next time or after a plurality of times. Besides, in the case where no lower limit of the clamp load is set, there is no need to return the clamp load to the initial value.

The disclosure is not limited to the aforementioned embodiments thereof, but can be appropriately changed within such a range as not to depart from the gist thereof.

In each of the aforementioned embodiments of the disclosure, the value of the clamp load to be reduced is calculated based on the difference between the calculated bending torque and the predetermined value. However, when the calculated bending torque is larger than the predetermined value, the clamp load may be reduced by a reduction value set in advance. In this case, every time it is determined that the calculated bending torque is larger than the predetermined value, the clamp load gradually decreases by the reduction value set in advance.

In each of the aforementioned embodiments of the disclosure, the disclosure has been described as a hardware configuration, but is not limited thereto. The disclosure can also be realized by causing a central processing unit (a CPU) to carry out an arbitrary process according to a computer program.

The program can be stored through the use of various types of non-transitory computer readable medium and supplied to a computer. The non-transitory computer readable medium includes various types of tangible storage medium. Examples of the non-transitory computer readable medium include magnetic recording medium (e.g., a flexible disc, a magnetic tape, and a hard disc drive), magneto-optical recording medium (e.g., a magneto-optical disc), a CD-ROM (a read only memory), a CD-R, a CD-R/W, and semiconductor memories (e.g., a mask ROM, a programmable ROM (a PROM), an erasable PROM (an EPROM), a flash ROM, and a random access memory (a RAM)). Besides, the program may be supplied to the computer by various types of transitory computer readable medium. Examples of the transitory computer readable medium include electric signals, optical signals, and electromagnetic waves. The transitory computer readable medium can provide the program to the computer via a wire communication path such as an electric wire, an optical fiber or the like, or a wireless communication path.

What is claimed is:

1. A control method for a winding wire manufacturing device, the winding wire manufacturing device including a base including a first clamping surface configured to be in contact with one surface of a rectangular wire in a thickness direction of the rectangular wire, a clamp that includes a shaft portion and a flange portion fixed to the shaft portion, the flange portion including a second clamping surface configured to be in contact with another surface of the rectangular wire in the thickness direction of the rectangular wire, the clamp being movable in the thickness direction of the rectangular wire and being configured to sandwich the rectangular wire between the first clamping surface of the base and the second clamping surface of the flange portion of the clamp, and a bending top that is configured to subject the rectangular wire to edgewise bending by pressing the rectangular wire against the shaft portion of the clamp while squeezing the rectangular wire into a space between the first clamping surface of the base and the second clamping surface of the flange portion of the clamp, the control method comprising:

a first process of detecting a bending torque applied to the bending top at a time of the edgewise bending;

a second process of determining whether a maximum value of torque is equal to or smaller than a predetermine value, the maximum value of torque being the detected torque, but not including a torque value detected immediately after the bending torque is applied to the bending top at a start time of the edgewise bending; and a third process of reducing a clamp load applied to the rectangular wire by the clamp when the maximum value is larger than the predetermined value.

2. The control method according to claim 1, wherein in the third process, the clamp load applied to the rectangular wire by the clamp is immediately reduced during control of the winding wire manufacturing device, when the maximum value becomes larger than the predetermined value.

3. The control method according to claim 1, wherein in the third process, the clamp load applied to the rectangular wire by the clamp is reduced after performing control of the winding wire manufacturing device a plurality of times.

4. The control method according to claim 1, further comprising:

a fourth process of determining whether or not it has been successively determined a predetermined number of times that the maximum value is equal to or smaller than the predetermined value, after reducing the clamp load applied to the rectangular wire by the clamp; and a fifth process of returning the clamp load applied to the rectangular wire by the clamp to an initial value set in advance, when it has been successively determined the predetermined number of times that the maximum value is equal to or smaller than the predetermined value.

5. The control method according to claim 4, further comprising a sixth process of refraining from adjusting the clamp load applied to the rectangular wire by the clamp, when it has not been successively determined the predetermined number of times that the maximum value of the bending torque is equal to or smaller than the predetermined value.

6. The control method according to claim 5, further comprising a seventh process of calculating an average of value of the maximum value in subjecting the rectangular wire to edgewise bending a plurality of times, wherein in the second process, it is determined whether or not the calculated average of the maximum value of the bending torque is equal to or smaller than the predetermined value.

7. A winding wire manufacturing device comprising:

abase including a first clamping surface that is configured to be in contact with one surface of a rectangular wire in a thickness direction of the rectangular wire;

a clamp that includes a shaft portion and a flange portion fixed to the shaft portion, the flange portion including a second clamping surface that is configured to be in contact with another surface of the rectangular wire in the thickness direction of the rectangular wire, the clamp being movable in the thickness direction of the rectangular wire, and being configured to sandwich the rectangular wire between the first clamping surface of the base and the second clamping surface of the flange portion of the clamp;

a bending top that is configured to subject the rectangular wire to edgewise bending by pressing the rectangular wire against the shaft portion of the clamp while squeezing the rectangular wire into a space between the first clamping surface of the base and the second clamping surface of the flange portion of the clamp; and a controller that is configured to reduce a clamp load applied to the rectangular wire by the clamp, when a maximum value of torque is larger than a predetermined value, the maximum value of torque being a bending torque applied to the bending top at a time of the edgewise bending, but not including a torque value detected immediately after the bending torque is applied to the bending top at a start time of the edgewise bending.

* * * * *